US007433486B2

(12) United States Patent
Kaiwa et al.

(10) Patent No.: US 7,433,486 B2
(45) Date of Patent: Oct. 7, 2008

(54) SPEAKER AND MANUFACTURING METHOD FOR THE SAME

(75) Inventors: Takeshi Kaiwa, Yamagata (JP); Satoshi Chiba, Yamagata (JP); Kunio Mitobe, Yamagata (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 570 days.

(21) Appl. No.: 10/853,273

(22) Filed: May 26, 2004

(65) Prior Publication Data

US 2004/0240702 A1 Dec. 2, 2004

(30) Foreign Application Priority Data

May 26, 2003 (JP) ..... P2003-147566

(51) Int. Cl.
*H04R 25/00* (2006.01)
*H04R 1/00* (2006.01)
*H04R 9/06* (2006.01)
*H04R 11/02* (2006.01)

(52) U.S. Cl. ..... 381/409; 381/410; 381/408; 379/433.1

(58) Field of Classification Search ..... 381/401, 381/408, 409, 410, 412, 423, 398, 430, 394, 381/395, 396; 340/384.1, 388.1, 388.3, 388.4, 340/388.5, 311.1, 391.1, 825, 407, 407.1, 340/44, 825.41, 390.1, 392.1, 392.2; 379/433.1; 367/17.5; 439/86, 492
See application file for complete search history.

(56) References Cited

U.S. PATENT DOCUMENTS 3,590,170 A * 6/1971 Sawyer et al. ..... 381/409
4,376,233 A * 3/1983 Kamon et al. ..... 381/409
5,838,809 A * 11/1998 Sato et al. ..... 381/409
6,269,167 B1 * 7/2001 Mango et al. ..... 381/410
6,587,570 B1 * 7/2003 Pavlovic ..... 381/400
6,597,798 B1 * 7/2003 Nakazono et al. ..... 381/410
6,671,952 B2 * 1/2004 Ono ..... 29/860
6,845,168 B2 * 1/2005 Kuwabara et al. ..... 381/409
7,050,601 B2 * 5/2006 Suzuki et al. ..... 381/409
2006/0265037 A1 * 11/2006 Kuzma ..... 607/116

FOREIGN PATENT DOCUMENTS

JP 56-098097 A 8/1981
JP 58-82099 U 6/1983
JP 62-155595 U 10/1987

(Continued)

OTHER PUBLICATIONS

Japanese Office Action dated Apr. 22, 2008.

*Primary Examiner*—Wayne Young
*Assistant Examiner*—Dionne H Pendleton
(74) *Attorney, Agent, or Firm*—Sughrue Mion, PLLC

(57) ABSTRACT

A lead wire of a voice coil is wired along the surface of a diaphragm. The lead wire is bent toward a reverse side of the diaphragm at a peripheral edge portion of the diaphragm. The lead wire is led to the interior of a frame. An external terminal is provided to extend from outside to inside the frame. In addition, a connecting portion for connecting the lead wire and the external terminal is provided inside the frame. The connecting portion is prevented from coming into contact with another part and becoming short-circuited.

7 Claims, 4 Drawing Sheets

FOREIGN PATENT DOCUMENTS

| | | | |
|---|---|---|---|
| JP | 63-81591 | U | 5/1988 |
| JP | 63-85991 | U | 6/1988 |
| JP | 64-44710 | U | 3/1989 |
| JP | 64-55795 | A | 4/1989 |
| JP | 8-280094 | A | 10/1996 |
| JP | 09-135495 | A | 5/1997 |
| JP | 9-284892 | A | 10/1997 |
| JP | 2003-087886 | A | 3/2000 |
| JP | 2002-209295 | A | 7/2002 |

* cited by examiner

SPEAKER AND MANUFACTURING METHOD FOR THE SAME

BACKGROUND OF THE INVENTION

1. Field of the Invention

The present invention relates to a technical field of speakers.

2. Description of the Related Art

A speaker is a so-called electroacoustic transducer for converting an electric signal (electric energy) from an amplifier to an acoustic signal (acoustic energy). In terms of its principle of operation, it is general to vibrate a diaphragm by a voice coil disposed in a magnetic circuit. An electric signal corresponding to a lead reproduced sound to the voice coil.

There are various forms in the shape of the diaphragm. In a dome speaker, the diaphragm has a dome shape. FIG. 6 shows a fragmentary sectional view of a dome speaker in the related art. FIG. 7 shows a bottom view of the dome speaker in the related art. In the dome speaker, a lead wire L led out from a voice coil (not shown) is wired around a surface of an edge damper portion 1 of the diaphragm. Then, the lead wire L is bent to follow an outer periphery of a frame 2 at an end of the edge damper portion 1. The lead wire L is connected to an external terminal 3. The external terminal 3 has a through hole 3*a*. The lead wire L is led to the bottom surface of the external terminal 3 through the through hole 3*a*. The lead wire L and the external terminal 3 are soldered at the bottom surface of the external terminal 3.

If a connecting portion 4 is thus exposed at the bottom surface of the external terminal 3, in a case where the speaker is built into electronic equipment or the like, there are cases where the connecting portion 4 comes into contact with another part, and the contacted part and/or speaker is electrically destroyed. Hence, there has been a problem in the perspective of safety.

In addition, since the dome speaker is suitable for making the equipment thin, the dome speaker is often used for compact portable equipment. High-density mounting is required in such applications, but it is necessary to provide a predetermined clearance in the layout so that the connecting portion and the other part do not contact each other.

SUMMARY OF THE INVENTION

It is an object of the invention to improve the safety of the speaker in view of the above problem.

According to first aspect of the invention, there is provided with a speaker including a diaphragm; a voice coil of vibrating the diaphragm by an electromagnetic force; a frame of forming an outer frame of the speaker; an external terminal having one end projecting outside of the frame and the other end extended inside of the frame; a lead wire led out from the voice coil, the lead wire wired along a surface of the diaphragm, the lead wire bent toward a reverse side of the diaphragm at a peripheral edge portion of the diaphragm, and the lead wire led to the inside of said frame; and a connecting portion in which the lead wire and the external terminal are connected inside of the frame.

DESCRIPTION OF THE PREFERRED EMBODIMENTS

In one embodiment of the invention, the speaker has a diaphragm, a voice coil for vibrating the diaphragm by an electromagnetic force, and a frame for forming an outer frame. An electric signal is supplied to the voice coil through a lead wire. The lead wire is wired along the surface of the diaphragm, is bent toward the reverse side at a peripheral edge portion of the diaphragm, and is led to the interior of the frame. The external terminal has one end projecting outside the frame and the other end extended to the interior of the frame. Further, the connecting portion for connecting the lead wire and the external terminal is provided inside the frame. Since the connecting portion is provided inside the speaker, the connecting portion is prevented from coming into contact with another part and becoming short-circuited. Consequently, it is possible to improve safety at the time of mounting the speaker, and improve the mounting density of parts.

It is preferable that the speaker has a dome speaker with a dome-shaped diaphragm. The diaphragm has a dome portion and an edge damper portion which may be integrally formed through a recessed portion. The voice coil is preferably formed in the recessed portion of the diaphragm.

In addition, as the lead wire wired along the surface of the diaphragm is bonded to the surface of the diaphragm by using an adhesive member, it is possible to prevent the disconnection of the lead wire. Further, as the lead wire bent toward the reverse side of the diaphragm is bonded to the frame by using the adhesive member, the lead wire can be fixed inside the frame as well. It is possible to further improve a reliability of the speaker.

Hereafter, a description will be given of embodiments of the invention by citing an outer magnet type dome speaker 100 and an inner magnet type dome speaker 200.

First Embodiment

Figure 1:
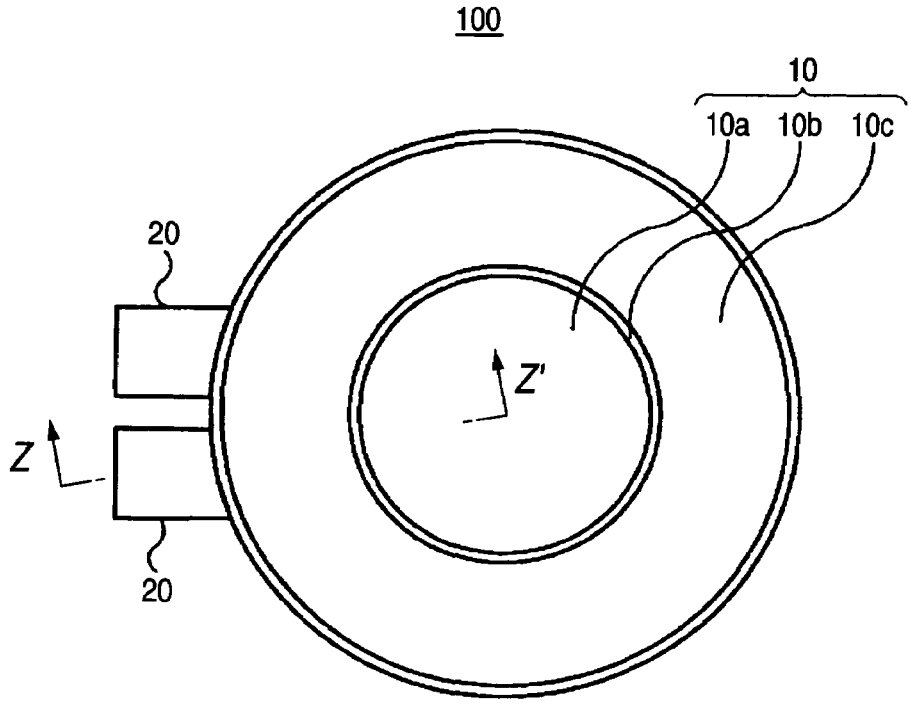
FIG. 1 is a top view of an outer magnet type dome speaker 100 in accordance with a first embodiment of the invention.
Figure 2:
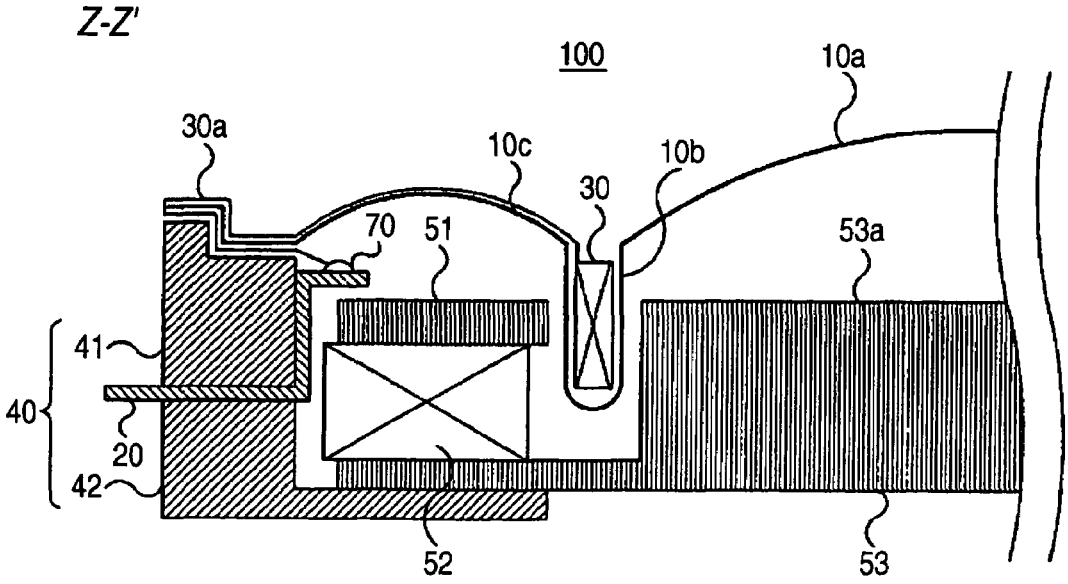
FIG. 2 is a cross-sectional view, taken along line Z-Z', of the dome speaker 100 shown in FIG. 1.

FIG. 1 is a top view of the outer magnet type dome speaker 100 in accordance with a first embodiment of the invention. FIG. 2 is a cross-sectional view, taken along line Z-Z', of the dome speaker 100 shown in FIG. 1. A diaphragm 10 has a dome portion 10*a* and an edge damper portion 10*c*, which are integrally formed with a recessed portion 10*b* disposed between the dome portion 10*a* and the edge damper portion 10*c*. The diaphragm 10 is integrally formed by, for example, subjecting one resin film to heating, pressurization, and molding. Basic materials of the resin film include polyimide, polyphenylene sulfide, and aramide films, and the like. The basic materials have no deformation at, for example, 100 C after the heating, pressurization, and molding and excel in the acoustic characteristics as well.

The recessed portion 10*b* of the diaphragm 10 has a U-shaped cross section. A cylindrical voice coil 30 formed by winding a wire is secured thereto by an adhesive member or the like. Two external terminals 20 are passed through a frame 40. One end of the external terminal 20 projects outside the frame 40, while the other end of the external terminal 20 extends inside the frame 40. The frame 40 has an upper frame 41 and a lower frame 42. The external terminal 20 is clamped between the upper frame 41 and the lower frame 42.

The edge damper portion 10*c* resiliently supports the dome portion 10*a* and the recessed portion 10*b*. As an outer peripheral edge portion of the edge damper portion 10*c* is fixed to the frame 40, the recessed portion 10*b* is positioned and floatingly suspended in a magnetic gap of a magnetic circuit which will be described later. Since the voice coil 30 is formed in the recessed portion 10*b*, the voice coil 30, together with the recessed portion 10*b*, is disposed and floatingly suspended in the magnetic gap of the magnetic circuit by the edge damper portion 10*c*.

An annular magnet 52 is disposed below the edge damper portion 10*c*. The magnet 52 is clamped by a plate 51 and a yoke 53. The yoke has a projecting portion 53*a* (so-called pole 53*a*) which is positioned below the dome portion 10*a*. A magnetic circuit having an annular magnetic gap is formed by the plate 51, the magnet 52, and the yoke 53. The magnetic gap is a gap between an inner side surface of the plate 51 and an outer side surface the pole 53*a* which oppose each other, and has a substantially uniform interval over the entire circumference.

Figure 3:
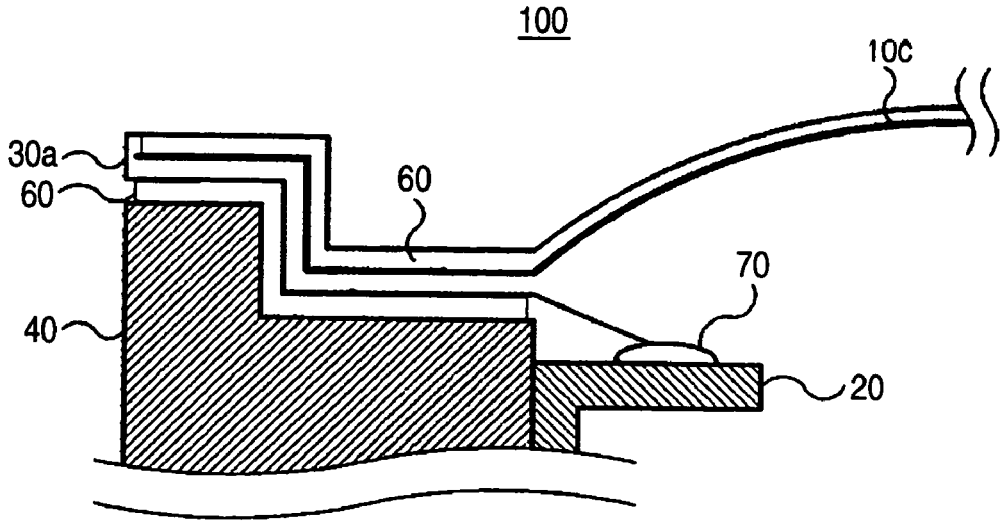
FIG. 3 is an enlarged view of essential portions of FIG. 2.

FIG. 3 is an enlarged view of essential portions of FIG. 2. A lead wire 30*a* of the voice coil 30 is wired along the surface of the edge damper portion 10*c* of the diaphragm 10, is bent toward the reverse side at the peripheral edge portion of the diaphragm 10 (peripheral edge portion of the edge damper portion 10*c*), and is led to the interior of the frame 40. When a signal is supplied to the dome speaker 100, the diaphragm 10 vibrates with a large acceleration, so that a large force is applied to the lead wire 30*a*. For this reason, the lead wire 30*a* wired along the surface of the diaphragm 10 is secured to the surface of the diaphragm 10 by using an adhesive member 60. As a result, it is possible to prevent the disconnection of the lead wire 30*a*.

Figure 4:
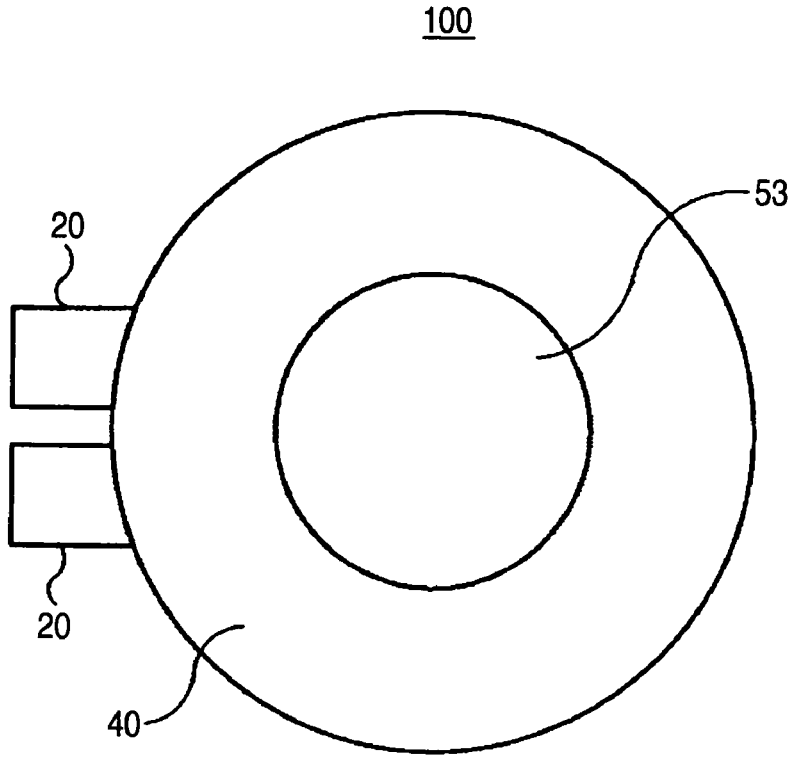
FIG. 4 is a bottom view of the dome speaker 100 in accordance with the embodiment.

Further, the lead wire 30*a* bent toward the reverse side of the diaphragm 10 is secured to the frame 40 by using the adhesive member 60. As a result, the lead wire 30*a* can be fixed inside the frame as well. Then, the lead wire 30*a* led to the interior of the dome speaker 100 is electrically connected to the external terminal 20 at a connecting portion 70. In this example, the connecting portion 70 is disposed in the space below the edge damper portion 10*c*. FIG. 4 is a bottom view of the dome speaker 100 in accordance with this embodiment. Since the connecting portion 70 is formed inside the frame 40 as described above, the connecting portion 70 is not formed on the external terminal 20 located outside the frame 40. Accordingly, even if this dome speaker 100 is built into electronic equipment, the connecting portion 70 does not come into contact with other parts. By making effective use of the inner space in this manner, it is possible to substantially improve safety at the time the dome speaker 100 is used by being built into electronic equipment. Further, it is possible to improve the mounting density of parts in the electronic equipment.

The dome speaker 100 can be manufactured by the following procedure. First, the lead wire 30*a* of the voice coil 30 is cut to a length necessary for wiring, and the coatings of its end portions are removed (first step). Next, the voice coil 30 is bonded to the recessed portion 10*b* of the diaphragm 10 by using the adhesive member (second step). Then, the lead wire 30*a* is wired along the surface of the edge damper portion 10*c* of the diaphragm 10, and is bonded to its surface by the adhesive member 60 (third step).

Then, the lead wire 30*a* is bent at the peripheral edge portion of the diaphragm 10, and the lead wire 30*a* is clamped by the diaphragm 10 and the upper frame 41, and is bonded by using the adhesive member 60 (fourth step). Then, each external terminal 20 is fitted and fixed to the upper frame 41 from the lower side of the upper frame 41, and the external terminal 20 and the lead wire 30*a* are soldered to form the connecting portion 70 (fifth step). Then, a subassembly in which the lower frame 42, the plate 51, the magnet 52, and the yoke 53 have been integrally formed is built onto the upper frame 41 from the lower side (sixth step). According to this manufacturing method, the connecting portions 70 can be formed inside the frame 40.

Second Embodiment

Figure 5:
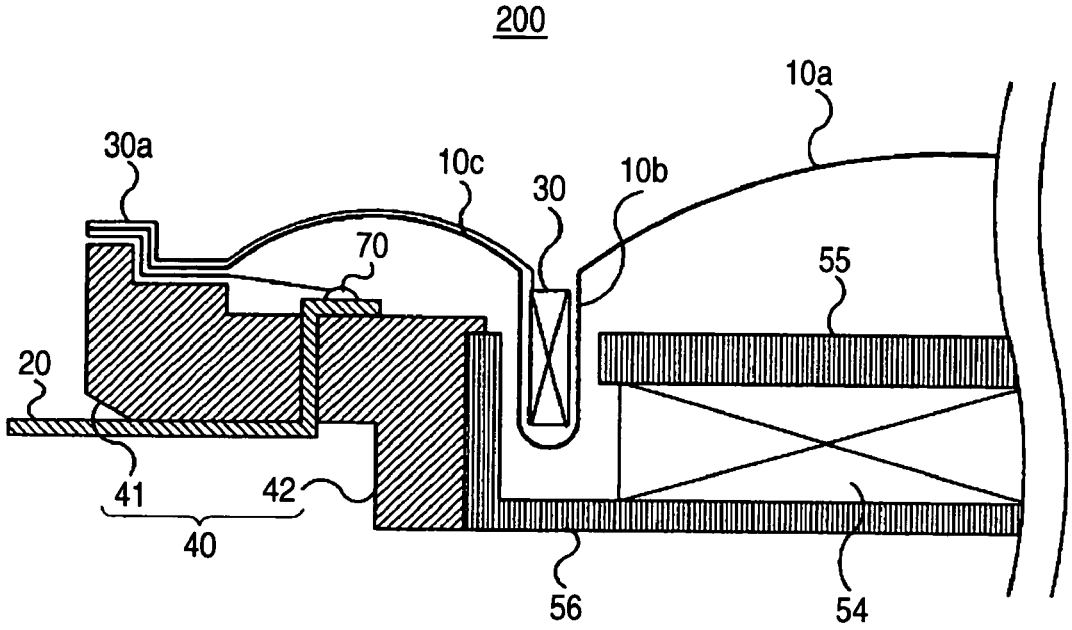
FIG. 5 is a cross-sectional view of a dome speaker 200 in accordance with a second embodiment.
Figure 6:
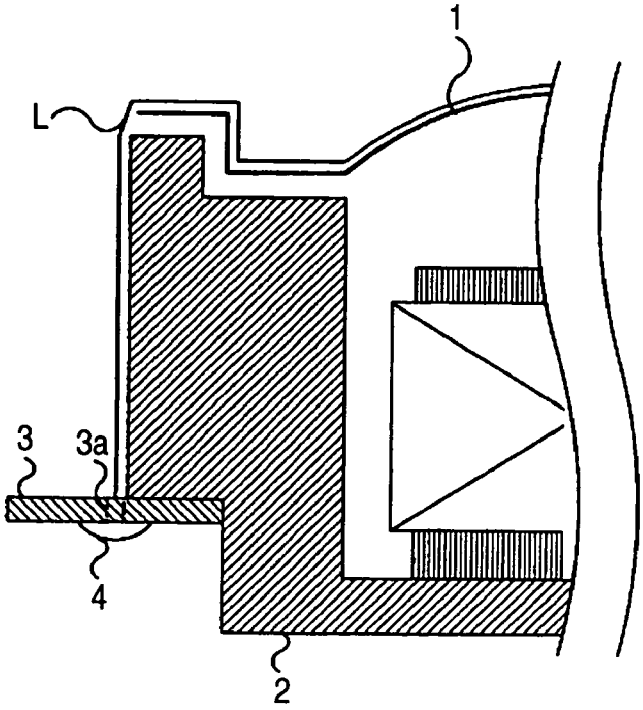
FIG. 6 is a fragmentary sectional view of a dome speaker in the related art.
Figure 7:
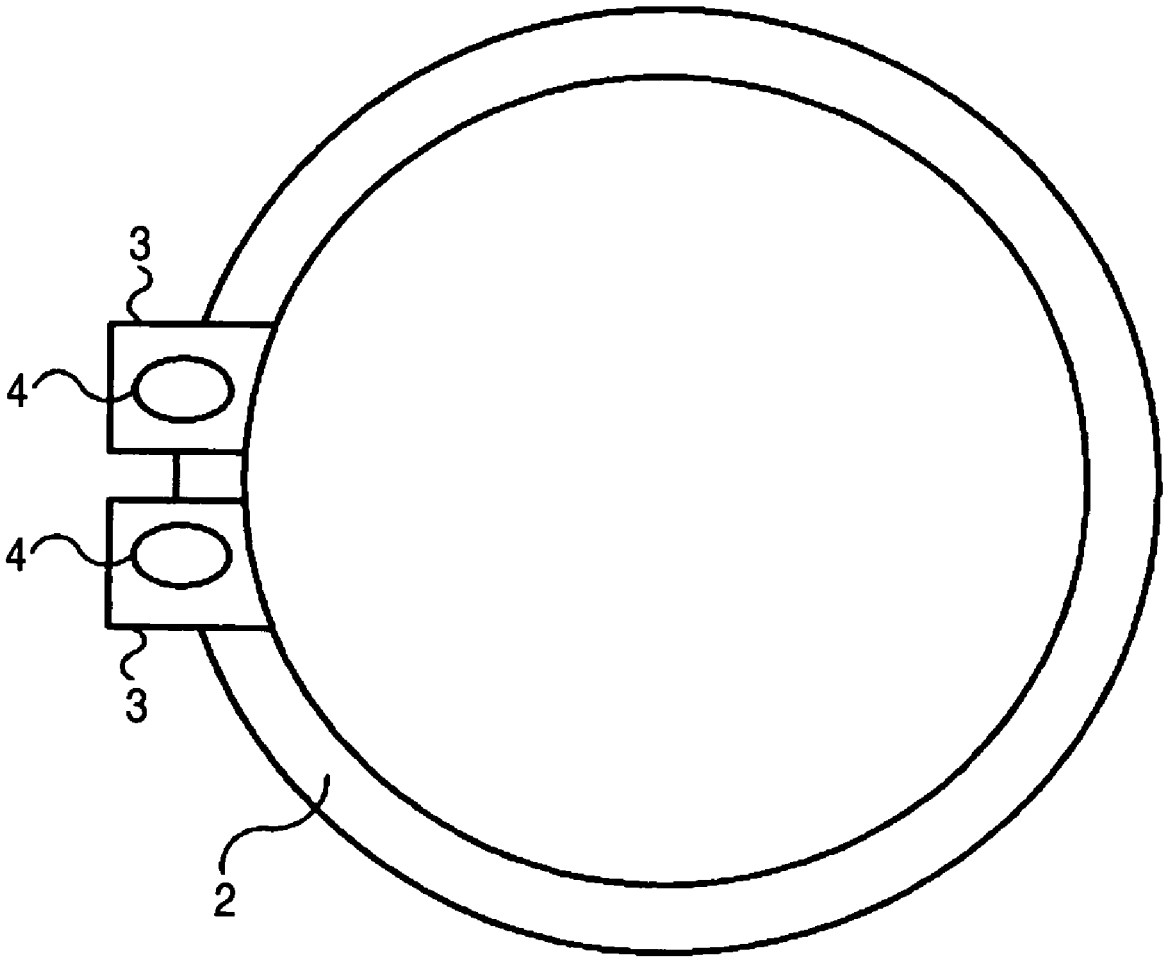
FIG. 7 is a bottom view of the dome speaker in the related art.

Next a description will be given of the inner magnet type dome speaker 200. The shape of the inner magnet type dome speaker 200 in accordance with the second embodiment is the same as the outer magnet type dome speaker 100 in accordance with the first embodiment shown in FIG. 1, but an internal structure of the dome speaker 200 is different from that of the dome speaker 100. FIG. 5 shows a cross-sectional view of the dome speaker 200. Arrangements that are identical to those of the dome speaker 100 of the first embodiment are denoted by the same reference numerals, and a description thereof will be omitted.

A magnet 54 has a cylindrical shape. The magnet 54 is disposed below the dome portion 10*a* on the inner side of the voice coil 30. A plate 55 is on top of the magnet 54. A yoke 56 is provided under the magnet 54. A side surface of the yoke 56 is opposed to the plate 55 with the voice coil 30 interposed therebetween. The magnetic circuit of this dome speaker 200 is formed by the magnet 54, the plate 55, and the yoke 56. The magnetic gap is a gap between the side surface of the plate 55 and an opposing portion of the yoke 56, and has a substantially uniform interval over the entire circumference.

In this embodiment as well, the external terminals 20 are passed through the frame 40. One end of the external terminal 20 projects outside the frame 40, while the other end of the external terminal 20 is extended inside the frame 40. Additionally, the lead wires 30*a* and the external terminals 20 are connected inside the frame 40 to form the connecting portions 70. Namely, by making effective use of the space below the edge damper portion 10*c*, the connecting portions 70 can be accommodated inside the speaker. Consequently, it is possible to substantially improve safety at the time the dome speaker 200 is used by being built into electronic equipment, and to improve the mounting density of parts in the electronic equipment.

The lead wire 30*a* is wired along the surface of the edge damper portion 10*c* of the diaphragm 10, and is secured by the adhesive member. The lead wire 30*a* is bent toward the reverse side at the peripheral edge portion of the diaphragm 10 (peripheral edge portion of the edge damper portion 10*c*), and is led to the interior of the frame 40. Further, the lead wire 30*a* bent toward the reverse side of the diaphragm 10 is secured to the frame 40 by using the adhesive member. As a result, the lead wire 30*a* is fixed reliably, so that it is possible to prevent its disconnection.

The dome speaker 200 can be manufactured by a manufacturing method similar to that of the above-described first embodiment.

The invention is not limited to the carrying-out mode and the embodiments described above, and the following modifications, for example, are possible.

(1) In the above-described first and second embodiments, the connecting portion 70 is provided on the upper surface of the external terminal 20 and on the lower side of the diaphragm 10. However, the connecting portion 70 may be provided on the lower surface of the external terminal 20 by providing a through hole in the external terminal 20, by leading the lead wire 30*a* out from the through hole, and by connecting the lead wire 30*a* to the lower surface of the external terminal 20. According to this modification, in the case where the connecting portion 70 is formed by soldering, it is unnecessary to insert a soldering iron into the narrow space, so that the operation can be performed with ease. In a case where this modification is applied to the second embodiment, it suffices if a recessed portion is formed in the lower frame 42 to allow the space for the connecting portion 70 to be secured.

(2) Although in the above-described first and second embodiments the dome type speaker has been described as one example, the invention is not limited to the same, and it goes without saying that the invention is applicable to any type of speaker.

What is claimed is:

1. A speaker, comprising:

a diaphragm;

a voice coil of vibrating the diaphragm by an electromagnetic force;

a frame of forming an outer frame of the speaker;

an external terminal having one end projecting outside of the frame and the other end extended inside of the frame;

a lead wire led out from the voice coil, the lead wire wired along a surface of the diaphragm, the lead wire bent toward a reverse side of the diaphragm at a peripheral edge portion of the diaphragm, and the lead wire led to the inside of said frame; and a connecting portion in which the lead wire and the external terminal are connected inside of the frame, wherein the diaphragm includes a recess portion formed at a sound-propagating side;

the voice coil is disposed in the recessed portion of the diaphragm;

the diaphragm includes an edge damper portion and outer peripheral edge portion;

the lead wire is led along a surface of the edge damper portion, the lead wire is wired along a surface of the outer peripheral edge portion, the lead wire is bent toward an opposite side at an outermost portion of the outer peripheral edge portion, and the lead wire is wired along a rear side of the outer peripheral edge portion; and the lead wire is fixed between the outer peripheral edge portion and the frame.

2. The speaker according to claim 1, wherein the lead wire is bonded to a surface of the diaphragm by using an adhesive member.

3. The speaker according to claim 1, wherein the lead wire is bonded to the frame at the reverse side of the diaphragm by using the adhesive member.

4. The speaker according to claim 1, further comprising:

a magnetic circuit including a magnet, a plate and a yoke;

wherein the diaphragm includes a dome portion, an edge damper portion and a recessed portion disposed between the dome portion and the edge damper portion, and wherein the magnet is disposed below the dome portion of the diaphragm on the inner side of the voice coil 30.

5. A manufacturing method of a speaker, comprising:

cutting a lead wire of a voice coil to a length necessary for wiring;

removing a coating of an end portion of the lead wire;

boding the voice coil to a recessed portion of a diaphragm by using an adhesive member;

wiring the lead wire along a surface of an edge damper of the diaphragm;

boding the lead wire to a surface of the diaphragm by the adhesive member;

bending the lead wire toward a reverse side of the diaphragm at a peripheral edge portion of the diaphragm;

clamping the lead wire by the diaphragm and an upper frame of the frame;

bonding the lead wire by the adhesive member;

fitting and fixing an external terminal to the upper frame of the frame from a lower side of the frame;

soldering the external terminal and the lead wire to form a connecting portion; and integrally forming an assembly including a lower frame of the frame, a plate, a magnet, and a yoke into the upper frame from the lower side of the frame.

6. The speaker according to claim 1, wherein the lead wire led out from the voice coil is wired along an obverse side of the diaphragm and the recessed portion of the diaphragm.

7. The speaker according to claim 1, wherein the lead wire led out from the voice coil is wired along an obverse side of the diaphragm and the recessed portion of the diaphragm.

* * * * *